US008842862B2

(12) United States Patent
Weidner

(10) Patent No.: US 8,842,862 B2
(45) Date of Patent: Sep. 23, 2014

(54) HEARING AID DEVICE WITH USER-CONTROLLED AUTOMATIC ADJUSTING MEANS

(75) Inventor: Tom Weidner, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1310 days.

(21) Appl. No.: 11/359,333

(22) Filed: Feb. 22, 2006

(65) Prior Publication Data

US 2006/0188106 A1 Aug. 24, 2006

(30) Foreign Application Priority Data

Feb. 23, 2005 (DE) ..... 10 2005 008 318

(51) Int. Cl.
*H04R 25/00* (2006.01)

(52) U.S. Cl.
CPC ..... *H04R 25/453* (2013.01); *H04R 25/558* (2013.01); *H04R 25/305* (2013.01)
USPC ..... 381/318; 381/317; 381/315; 381/73.1; 381/83

(58) Field of Classification Search
CPC .. H04R 25/305; H04R 25/453; H04R 25/558; H04R 25/407; H04R 25/552
USPC ..... 381/60, 314, 315, 317, 318
See application file for complete search history.

(56) References Cited

U.S. PATENT DOCUMENTS 4,471,171 A * 9/1984 Köpke et al. ..... 381/60
4,731,850 A 3/1988 Levitt et al.
4,783,818 A 11/1988 Graupe et al.
4,955,729 A 9/1990 Marx
5,091,952 A * 2/1992 Williamson et al. ..... 381/318
5,991,417 A 11/1999 Topholm
6,035,050 A * 3/2000 Weinfurtner et al. ..... 381/313

(Continued)

FOREIGN PATENT DOCUMENTS

DE 3109049 C2 6/1989
DE 41 28 172 C2 3/1993

(Continued)

OTHER PUBLICATIONS

Nikolai Bisgaard and Ole Dyrlund, "DFS—ein neues digitales System zur Rückkopplungsunterdrückung in Hörgeräten", Audiologische Akustik May 1991, pp. 166, 168, 173-177.

(Continued)

*Primary Examiner* — Davetta W Goins
*Assistant Examiner* — Jasmine Pritchard
(74) *Attorney, Agent, or Firm* — Laurence A. Greenberg; Werner H. Stemer; Ralph E. Locher

(57) ABSTRACT

The adjustment of a hearing device with regard to a current feedback path is to be designed in a more user-friendly manner. For this purpose, provision is made for hearing aid equipment, in particular a hearing device or a non-programmable device such as a headset, including a measuring device for measuring a feedback path and an operating facility for operating the hearing aid equipment by the wearer. The operating facility allows a measurement cycle to be activated to determine at least one characteristic of the feedback path. The hearing aid wearer can thus make adjustments themselves in terms of the feedback path and therefore does not have to rely on an acoustician.

14 Claims, 2 Drawing Sheets

(56) References Cited

U.S. PATENT DOCUMENTS

| | | | | |
|---|---|---|---|---|
| 6,128,392 | A | 10/2000 | Leysieffer et al. | |
| 6,236,731 | B1 * | 5/2001 | Brennan et al. | 381/316 |
| 6,404,895 | B1 | 6/2002 | Weidner | |
| 6,606,391 | B2 * | 8/2003 | Brennan et al. | 381/316 |
| 6,842,647 | B1 | 1/2005 | Griffith et al. | |
| 7,463,745 | B2 * | 12/2008 | Miller, III | 381/318 |
| 2001/0010513 | A1 | 8/2001 | Rosenberg et al. | |
| 2002/0015506 | A1 * | 2/2002 | Aceti et al. | 381/314 |
| 2002/0026091 | A1 | 2/2002 | Leysieffer | |
| 2002/0176594 | A1 * | 11/2002 | Hohmann et al. | 381/312 |
| 2004/0136557 | A1 * | 7/2004 | Kaulberg | 381/318 |
| 2005/0078842 | A1 * | 4/2005 | Vonlanthen et al. | 381/312 |

FOREIGN PATENT DOCUMENTS

| | | | |
|---|---|---|---|
| DE | 19904538 | C1 | 7/2000 |
| DE | 100 41 726 | C1 | 5/2002 |
| DE | 10345173 | B3 | 1/2005 |
| EP | 0 415 677 | B1 | 3/1991 |
| EP | 0581261 | A1 | 2/1994 |
| EP | 0 634 084 | B1 | 1/1995 |
| WO | WO 94/09604 | A1 | 4/1994 |

OTHER PUBLICATIONS

Sandlin Robert E.; "Understanding Digitally Programmable Hearing Aids"; Allyn and Bacon A Division of Simon & Schuster Inc.; pp. 305-309; ISBN: 0-205-14845-X; 1993.

* cited by examiner

HEARING AID DEVICE WITH USER-CONTROLLED AUTOMATIC ADJUSTING MEANS

CROSS REFERENCE TO RELATED APPLICATION

This application claims priority of the German application No. 10 2005 008 318.8 DE filed Feb. 23, 2005, which is incorporated by reference herein in its entirety.

FIELD OF THE INVENTION

The present invention relates to a hearing aid device with a measuring device for measuring a feedback path and an operating facility for operating the hearing device by the hearing aid wearer.

BACKGROUND OF THE INVENTION

Two previous approaches are known for adapting a hearing aid device to an individual feedback situation. With a first approach, the actual feedback path or its characteristics is not known and adaptation is an ongoing process, with the danger of artifacts being very high. According to the second approach, the actual feedback path is first measured by an adapting computer or a programming device. Basic values for the feedback reduction are produced from this measurement and only a minimal ongoing adaptation still needs to be carried out by the hearing device based on these basic values or this fine adaptation is dispensed with altogether. Since a special adapting computer is necessary for measuring the feedback path, the measurement is only carried out by an acoustician and never however by a hearing aid wearer themselves.

U.S. Pat. No. 4,783,818 discloses a method and a device for the adaptive filtering of acoustic feedback signals. In order to identify the acoustic feedback parameters, the configuration of the communication system is changed from a conventional operating mode into a parameter identification mode. In this case, the amplifier is conventionally separated from the microphone and the loudspeaker and is replaced by an identification circuit. Automatic toggling between the two modes takes place as a function of a threshold value. The disadvantage here is that under some circumstances the hearing device fails very frequently during normal hearing operation, namely whenever it switches to identification mode.

Publications EP 0 415 677 B1, EP 0 634 084 B1 and WO 94/09604 also disclose hearing aids with feedback suppression. In this case own noise sources are partially used.

Furthermore, a digital hearing aid is described in the patent application DE 41 28 172 C2, in which an acoustic sensor detects an otoacoustic response of the inner ear of the hearing aid wearer to the measuring tones emitted by an electroacoustic converter. With the aid of the relevant sensor voltage, a microcomputer carries out a comparison and a correction of the transmission function. The measuring and correction process is initiated for instance by activating a key connected to the microcomputer, said key having the function of a switch.

The article Bisgaard, Nikolai; Dyrlund, Ole; "DFS—ein neues digitales System zur Rückkopplungsunterdrückung in Hörgeräten"; (DFS a new digital system for feedback suppression in hearing devices) in Audiological Acoustics 5/91, pages 166, 168 and 173-177 discloses a digital system for feedback suppression in hearing devices. The feedback signal is defined here as a part of the output signal which is fed to the microphone. The feedback either takes place via a ventilation flute or a leakage between the ear canal piece and the auditory canal. If the attenuation on the path of the feedback signal is lower than the amplification of the hearing device, oscillation with a very high acoustic pressure occur in the system. The digital feedback suppression system constantly measures the frequency curve of the feedback path and generates a correction system which is superimposed with the input signal in order to suppress the feedback. This system nevertheless also includes the above-mentioned disadvantages of a constantly adapting system.

SUMMARY OF THE INVENTION

As illustrated in exemplary embodiment of FIG. 2, the object of the present invention is thus to design the feedback reduction for the user of a hearing device 10 to be as user-friendly as possible.

In accordance with the invention, provision is made for the hearing device 10 with a measuring device 12 for the purpose of measuring a feedback path in the hearing device 10 and an operating facility 14 for operation of the hearing device 10 by the wearer, with a measuring cycle for determining at least one characteristic of the feedback path being activated using the operating facility 14.

As further illustrated in the exemplary embodiment of FIG. 2, the invention is based on the concept of creating the hearing device 10 with a feedback compensator 15, which initializes in a self-activating manner after a conscious activation by the wearer and/or hearing device wearer. For this purpose, a type of adaptive filtering can be used for instance for the feedback compensation, which, however, only adapts during an adjustment phase and is not permanent. The parameters determined in this way are permanently maintained thereafter. This means that the hearing device 10 can automatically measure the current feedback path at the instigation of the hearing device wearer and can store it, depending on the program, permanently in the hearing device 10 without a programming device additionally having to be connected to the hearing aid device 10 or any connection having to be established with an external computer.

The operating facility 14 of the hearing device 10 is preferably realized as a remote control. An individual circuit mechanism can thus be omitted for the activation of the measuring phase.

As further illustrated in the exemplary embodiment of FIG. 2, the operating facility 14 can comprise a number of keys 16, with the measuring cycle being activatable by a key combination. The measuring cycle can however also be activated by a predetermined chronological sequence of an activation of a key. Keys 16 can be used in this manner for activating the measuring cycle, the keys 16 also being used for other functionalities. According to a similarly preferred embodiment, the operating facility 14 is not arranged to be visible in the shell 18 of the hearing aid device and/or the hearing device 10 from the outside. For this purpose, the operating facility 14 can comprise a reed relay as a magnetic field detector for instance or a high frequency detector 17. Both allow the hearing device 10 to be operated through the hearing device shell 18.

As further illustrated in the exemplary embodiment of FIG. 2, it is also advantageous if the hearing device 10 according to the invention comprises a signal generator 20 for outputting a control tone when the measuring cycle is activated and/or terminated. Alternatively or in addition, a control tone can also be output with a successful/unsuccessful implementation of of the measuring cycle. Optical or tactile signals for controlling the measuring cycle are also suitable instead of the control tone.

In a special embodiment, the operating facility 14 comprises an acoustic receiver 26 so that the measuring cycle can be activated or influenced by a tone or a sequence of tones. The measuring cycle can thus be activated with the aid of a cell phone for instance, where the cell phone is emitting the corresponding key tones.

BRIEF DESCRIPTION OF THE DRAWING

The present invention is now described in more detail with reference to the appended drawing which shows a flow diagram for the adjustment of a hearing aid device.

DETAILED DESCRIPTION OF THE INVENTION

Figure 1:
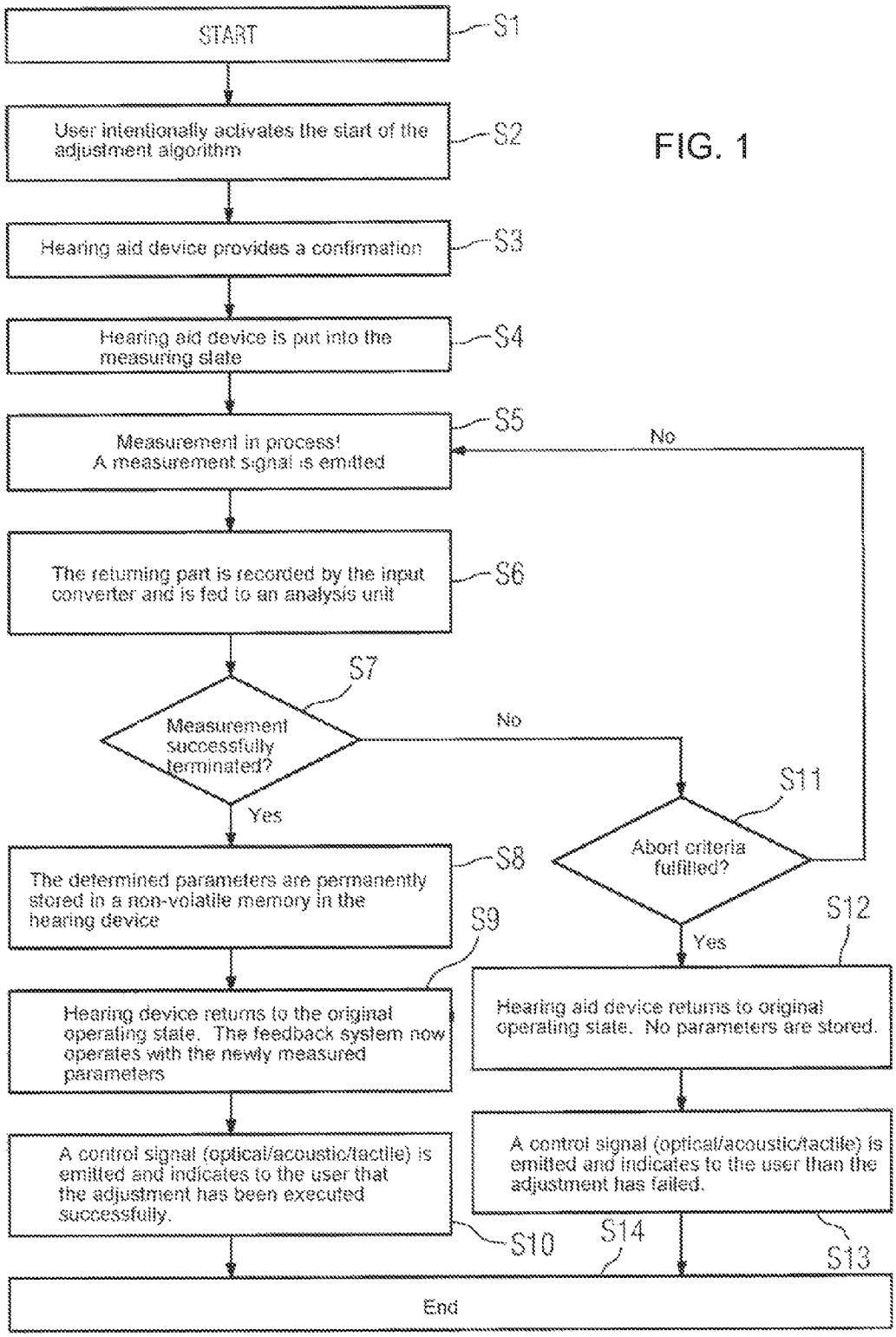
FIG. 1—a flow chart providing the details of the preferred embodiment.
Figure 2:
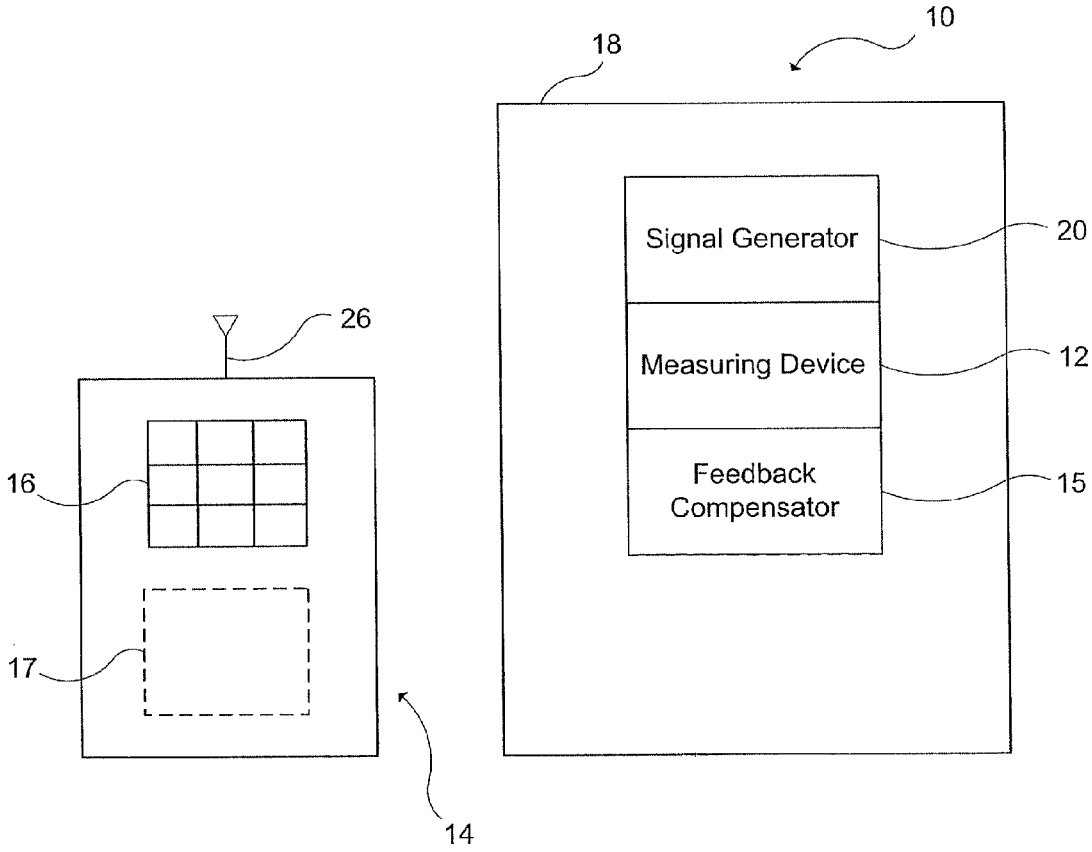
FIG. 2—a schematic diagram providing the details of an exemplary embodiment of the hearing device.

The exemplary embodiment illustrated in more detail below displays a preferred embodiment of the present invention.

A special control is implemented in a hearing device according to the invention, said control being activated by a predetermined operation of the hearing device for implementing a measuring process. The measured coefficients are written into a non-volatile memory in the hearing device. From this time, the feedback algorithm present in the hearing device remains initialized with the measured parameters even after switching off and a battery change. An effective feedback reduction is thus immediately provided. As the feedback algorithm must no longer be adapted, there are no adapting artifacts.

The advantage of the adjustment methods according to the invention is that complex algorithms such as a feedback compensator can be individually adjusted and initialized even with non-programmable devices (e.g. headsets) or with devices in which the adaptation is not carried out by an acoustician. Adjustment processes are thus more user-friendly.

In detail, the adjustment process is carried out according to the steps shown in the figure. Step S1 symbolically indicates that the hearing equipment or particularly the hearing device is ready to implement a measuring process. In a step S2, the user activates the adjustment process by an intentional operation. For this purpose, an operating instruction or other information provides the hearing aid wearer with the necessary details and explanations for the system. For example, a special key combination or a control element must be activated in a specific chronological sequence. This can be implemented both directly on the hearing device and on any available remote control. As already mentioned, a further alternative consists in providing a non-visible control element e.g. a reed relay or a RFID detector and starting the adjustment process of the hearing device via this device.

After the start of the adjustment process, the hearing device usefully emits a control signal (step S3), which indicates the start of the adjustment to the hearing aid wearer. This control signal can be a tone, but also an optical signal. In a subsequent step S4, the hearing device is put into the measuring state. In this state any specific device settings which may be required are made.

The measuring process is thus started according to step S5, and a measurement signal is emitted. For example, a defined noise is emitted via the earpiece. The returning part of the measurement noise is recorded by an input converter, e.g. a microphone, according to step S6 and is fed to an analysis unit.

In a step S7 a check is carried out as to whether the measurement was terminated successfully. In this case, a check is carried out as to whether a measurement time has expired and/or a fault parameter has fallen below a specific limit. After successful measurement, the measured parameters for the current program are permanently stored in a non-volatile memory in the hearing device according to step S8. The hearing device subsequently returns to the original operating state according to step S9. The feedback system now operates with the newly measured parameters. Hereupon the hearing device according to step S10 emits a control signal to the hearing device wearer about the successful measurement. This control signal can also be of an optical, acoustic or also a tactile nature. The feedback algorithm is now available with the up-dated pre-adjustments and can operate without artifacts, since additional adaptation is not necessary or only necessary to a very minimal extent.

If a renewed adjustment is subsequently necessary on the basis of changes to the position of the otoplastic or the hearing device, this can be easily implemented by repeating the above-mentioned sequence. In principal, the sequence can be repeated as often as necessary.

If the measurement is still not terminated after step S7, one or more abort criteria are monitored according to step S11. These include exceeding a time limit or the presence of a specific fault condition for example. If the abort criteria are not fulfilled, the measurement continues with step S5. If, in contrast, an abort criterion applies, the hearing device returns to the original operating status according to step S12, but no parameters are stored. This means that the feedback system operates again with the former parameters.

With the unsuccessful measurement too, a control signal or an optical, acoustic or tactile nature is also emitted according to step S13 and it is indicated to the user that the adjustment, i.e. the measurement of the feedback path has failed. The end of the complete measurement process is shown in the diagram by step S14.

The described method for adjusting a hearing aid device in terms of a feedback path can be used for any hearing devices but also for non-programmable headsets and the like. In each case, a statistical, currently optimized compensation of the feedback can be achieved by the adjustment. In many cases this removes the need for a dynamic compensation or the dynamic compensation can be undertaken within a very restricted framework.

The invention claimed is:

1. A hearing device, comprising:

a measuring device for measuring a feedback path of the hearing device, said feedback path measured as a portion of an output signal from the hearing device that is fed back into the hearing device;

an operating facility for operating the hearing device by the wearer, wherein a measuring cycle for determining at least one characteristic of the feedback path is activated using the operating facility; and a feedback compensator comprising parameters, wherein the hearing device is configured to determine whether the measuring cycle has terminated successfully or unsuccessfully by checking whether a predetermined abort criterion has been fulfilled, the predetermined abort criterion including an expiration of a measurement time and/or a presence of a specific fault condition, wherein the hearing device is configured to determine that the measurement has terminated unsuccessfully and to return to an original operating status without storing measured parameters determined during the measuring cycle and thus to operate again with the parameters of the feedback compensator in the original operating status when a result of the checking indicates that the predetermined abort criterion has been fulfilled, and wherein the hearing device is configured to determine that the measurement has terminated successfully and to store the measured parameters determined during the measuring cycle in a non-volatile memory, for use in a feedback algorithm when a result of the checking indicates that the predetermined abort criterion has not been fulfilled.

2. The hearing device according to claim 1, wherein the measuring cycle is activatable by a predetermined chronological sequence of an activation of a key.

3. The hearing device according to claim 1, wherein the operating facility is arranged in a shell of the hearing device and is invisible from outside of the shell.

4. The hearing device according to claim 3, wherein the operating facility further comprises a magnetic field detector or a high frequency detector.

5. The hearing device according to claim 1, further comprising a signal generator to output a control signal during the activation.

6. The hearing device according to claim 1, further comprising a signal generator to output a control signal during the termination of the measuring cycle.

7. The hearing device according to claim 1, wherein the operating facility further comprises an acoustic receiver so the measuring cycle is activated or influenced by a tone or a sequence of tones.

8. The hearing device according to claim 1, wherein said measuring device is configured to measure the feedback path based on comparing an attenuation of the output signal being fed back into the hearing device, to an amplification of the hearing device.

9. The hearing device according to claim 5, wherein the control signal is a tone.

10. The hearing device according to claim 5, wherein the control signal is an optical signal.

11. The hearing device according to claim 5, wherein the control signal is a tactile signal.

12. The hearing device according to claim 6, wherein the control signal is a tone.

13. The hearing device according to claim 6, wherein the control signal is an optical signal.

14. The hearing device according to claim 6, wherein the control signal is a tactile signal.

* * * * *